US008622096B2

(12) United States Patent
Yang

(10) Patent No.: US 8,622,096 B2
(45) Date of Patent: Jan. 7, 2014

(54) SPIN IMPROVEMENT STRING PLIERS

(76) Inventor: Luyu Yang, Tyngsborough, MA (US)

( * ) Notice: Subject to any disclaimer, the term of this patent is extended or adjusted under 35 U.S.C. 154(b) by 395 days.

(21) Appl. No.: 12/833,981

(22) Filed: Jul. 10, 2010

(65) Prior Publication Data

US 2012/0010032 A1 Jan. 12, 2012

(51) Int. Cl.
*B21F 9/00* (2006.01)
*B25B 7/02* (2006.01)

(52) U.S. Cl.
USPC ..... 140/123; 140/123.5; 81/418

(58) Field of Classification Search
USPC ..... 140/106, 123, 123.5, 105; 72/409.01–409.19, 479; 81/415, 418, 81/424.5, 426, 426.5; 473/543
See application file for complete search history.

(56) References Cited

U.S. PATENT DOCUMENTS

| | | | | | |
|---|---|---|---|---|---|
| 371,639 | A * | 10/1887 | Taylor | 140/106 |
| 685,215 | A * | 10/1901 | Magui | 81/342 |
| 2,716,365 | A * | 8/1955 | Keeley, Jr. | 81/416 |
| 2,934,983 | A * | 5/1960 | Daggitt | 72/409.01 |
| 2,990,863 | A * | 7/1961 | Pantermoller | 81/418 |
| 3,626,995 | A * | 12/1971 | Keenan, Jr. | 140/106 |
| 5,084,935 | A * | 2/1992 | Kalthoff | 72/409.01 |
| 5,165,155 | A * | 11/1992 | Adams | 29/268 |
| 6,386,077 | B1 * | 5/2002 | Hartman | 81/426 |
| 7,114,414 | B1 * | 10/2006 | Peck | 81/3.6 |
| 7,124,786 | B1 * | 10/2006 | Gowhari | 140/118 |
| 8,052,420 | B2 * | 11/2011 | Navarro | 433/4 |
| 2005/0051000 | A1 * | 3/2005 | McIlvenna et al. | 81/44 |

* cited by examiner

*Primary Examiner* — Dana Ross
*Assistant Examiner* — Pradeep C Battula

(57) ABSTRACT

The spin improvement string pliers is a pivotally secured together plier device used to manually restructure and roughen the surface of a synthetic string on a strung tennis racquet by means of plastic deformation. The line grids on the pliers depress the string, leaving a series of indentations on the string surface that increases the friction between the string and the ball so that the tennis player can more easily generate top or under spin on a tennis ball or a racket ball.

7 Claims, 4 Drawing Sheets

SPIN IMPROVEMENT STRING PLIERS

FIELD OF INVENTION

The present invention relates to a pivotally secured together plier device used to manually restructure and roughen the surface of a synthetic tennis string on a strung tennis racquet. The roughened string surface increases the friction between the string and the tennis ball and thus the player can more easily generate spin on a tennis ball or a racket ball while striking the ball.

BACKGROUND OF THE INVENTION

Many tennis players try many different techniques to generate spin when they hit the tennis balls. The spin is generated by friction between the string and the ball. Thus, the rougher the string surface is, the easier it is for the player to generate spin. However, most strings, especially the new synthetic strings, are cylindrical in shape and have a smooth surface, making it difficult for players to generate a high speed spin on the tennis balls.

Most strings are made of synthetic fiber and some of them are made of natural gut. Some string manufacturers provide Octagon or Hexagon shaped strings to increase the friction between the string and ball. It may be effective on the main string, but it does not make any difference on the cross string because of the direction of the racquet swing movement. In addition, after some time, the sharp edge of the Octagon and Hexagon will be worn away by wear and tear between the string and ball. Some strings come with a series of small dents on the surface to increase the roughness of the string surface. This is effective when it is new, however, after some time, the small dents will be worn off and the string surface becomes smooth again.

Even though the above mentioned non-cylindrical strings are commercially available, they can be expensive and/or lose some other good quality characteristics compared to traditional cylindrical shaped strings. Cylindrical shaped strings are still the most commonly used strings.

BRIEF SUMMARY OF THE INVENTION

The primary objective of this invention is to provide a plier device to mechanically and permanently restructure the surface of a tennis racquet string, section by section on a strung tennis racquet, by means of mechanical deformation on a string.

In accordance with the present invention, there is provided a plier device comprising a pair of handle levers including a middle portion pivotally secured together with a pivot shaft. Each lever has a handle on one end and a jaw on the other. The plier device is made of steel or another hard material. Both upper jaw and bottom jaw have an elevated pattern of closely adjacent line grids. The end of the bottom jaw has an "L" shaped string locker design with a slot in the middle, which allows the bottom jaw to slide beneath a string by rotating the plier handles. Once the upper jaw is above the string and bottom jaw is beneath the string, close the pliers. A series of elevated line grids will then press and reform the string surface and leave a series of indentations on the string without damaging other characteristics of the string. The roughened string surface increases friction between the string and ball, making it easier for the players to generate spin. After some time, if the indentations on the string are removed because of wear and tear, the pliers can be used again to roughen the string.

DETAILED DESCRIPTION OF THE INVENTION

Figure 3:
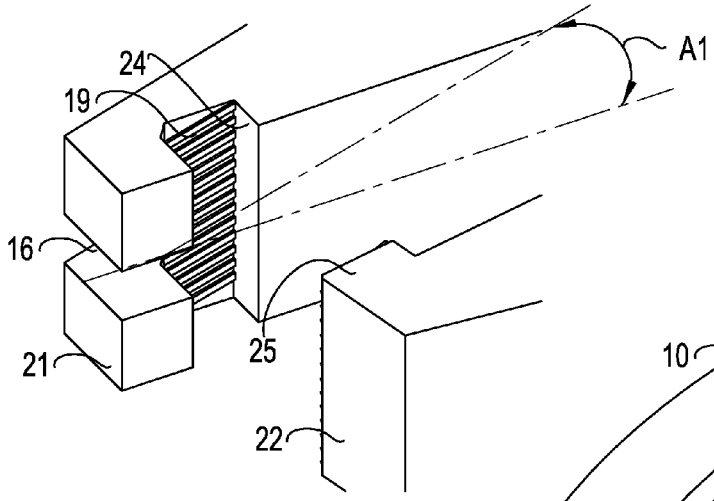
FIG. 3 is a close up exploded view of the bottom jaw when the pliers are open.
Figure 1:
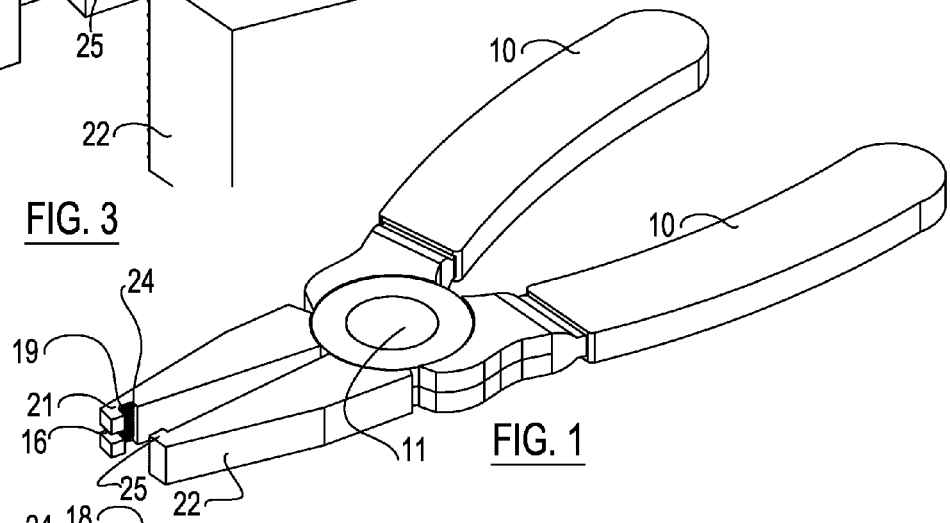
FIG. 1 is an exploded view of the string pliers in accordance with the present invention.
Figure 2:
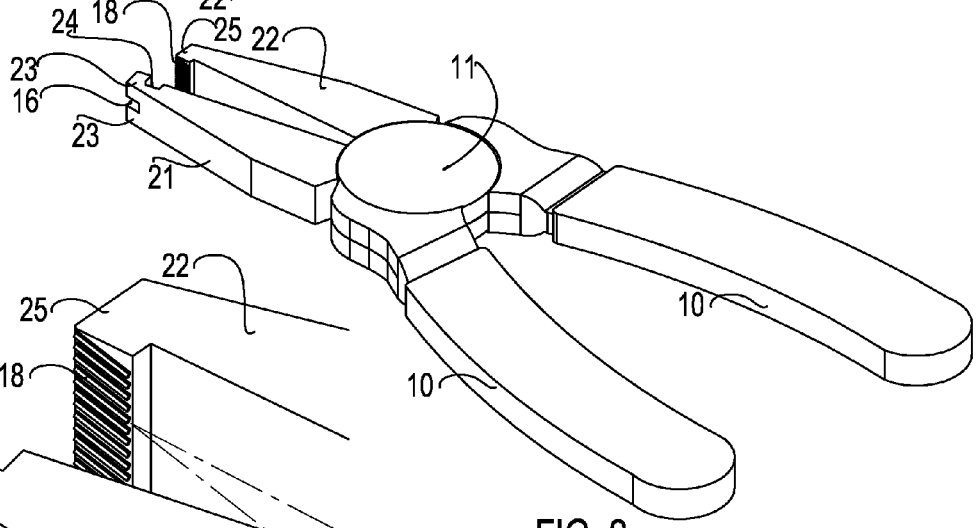
FIG. 2 is another exploded view of the string pliers in accordance with the present invention.
Figure 4:
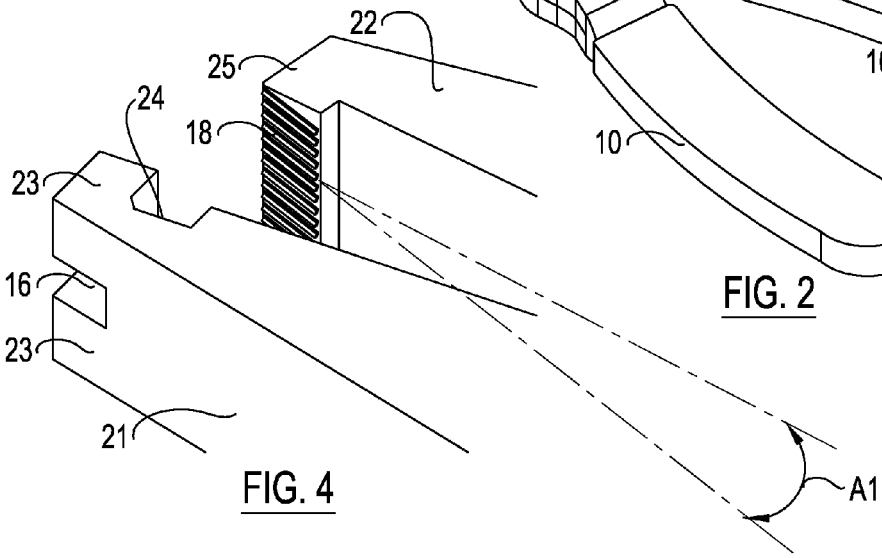
FIG. 4 is a close up exploded view of the upper jaw when the pliers are open.
Figure 5:
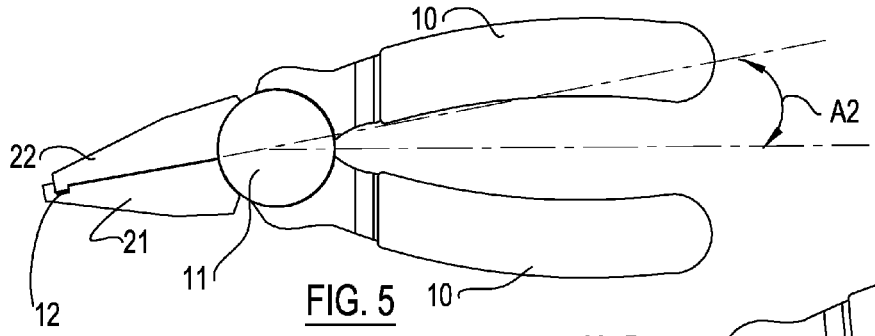
FIG. 5 is a front view of the string pliers when they are closed.
Figure 6:
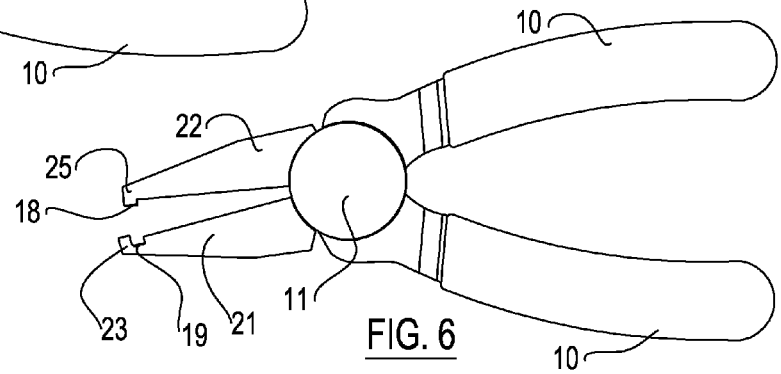
FIG. 6 is a front view of the string pliers when they are open.

Referring to FIG. 1 and FIG. 2, the tool of the present invention can be seen to include two plier handles 10-10 which pivot about pivot pin 11. One of the handles 10-10 is rigidly connected to upper jaw 22 and the other handle is rigidly connected to lower jaw 21. When handles 10-10 are spread apart, the jaws open, as shown in FIG. 1, FIG. 2 and FIG. 6, and when the handles 10-10 are closed, the jaws close, as indicated in FIG. 5. Upper jaw 22 and lower jaw 21 contain an elevated pattern of adjacent line grids 18 and 19, as indicated in FIG. 3 and FIG. 4. The line grids 18 and 19 can come with different shapes, a rectangular block, a pyramid, a triangle or a half cylinder.

The upper jaw 22 and lower jaw 21 are shown in greater detail in FIG. 3 and FIG. 4. The upper jaw 22 has an elevated L shaped jaw tip 25 at the end. An elevated pattern of elements 18 is on the top of elevated L shaped jaw tip 25. Right beneath the elevated L shaped jaw tip 25 on the upper jaw 22, a recessed indentation 24 is located on the lower jaw 21. The indentation 24 is about ⅛"-½" wide and 3/16" to 5/16" deep. An elevated pattern of line grids 19 is on the top of the recessed indentation 24, as indicated in FIG. 3. The recessed indentation 24 is to lock the string in place once the lower jaw 21 slides beneath the string. Upon closure of the upper jaw 22 and the lower jaw 21, a gap 12 is formed between line grids on the upper jaw 22 and the lower jaw 21, as indicated in FIG. 5. The formed gap 12 is about 1/32" which prevents the string from being cut by the elevated line grids 18 and 19 on the upper jaw 22 and lower jaw 21 respectively.

The lower jaw 21 has 2 elevated L shaped string lockers 23 at the end, which are extruded from upper jaw 22, as indicated on FIG. 5. Between these two L shaped string lockers 23, at the end of lower jaw 21, a slot 16 about ⅛" in width and ½" in depth is located in the center.

In FIG. 3 and FIG. 4, it can be seen that the center lines of the elevated pattern line grids 18 and 19 are not parallel to the center lines of the upper jaw 21 and lower jaw 22. Instead, these two lines form an angle A1. Angle A1 indicated in FIG. 3 and FIG. 4 may vary from about 15° to about 30°, or more preferably from about 20° to 25°. This feature allows the string pliers to make indentation marks on the strings that are not vertical or parallel to the center line of the main or cross strings. This design makes it easier for tennis players to generate spin on the balls.

In FIG. 5, it can be seen that the center line of upper jaw 22 and bottom jaw 21 is not parallel to the center line of the handles 10 of the pliers. Instead, it forms an angle A2. This feature makes the tool of the present invention much easier to operate than if it had the center line of upper jaw 22 and lower jaw 21 in direct alignment with the center line of the plier handles 10. Angle A2 indicated in FIG. 5 may vary from about 15° to about 35°, or more preferably from about 20° to 25°.

Figure 7:
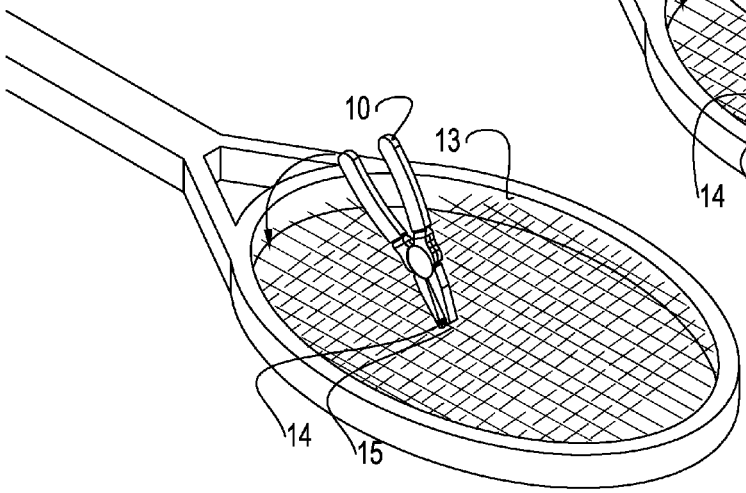
FIG. 7 is an exploded view of step 1 of how to use the string pliers on a strung racquet.
Figure 8:
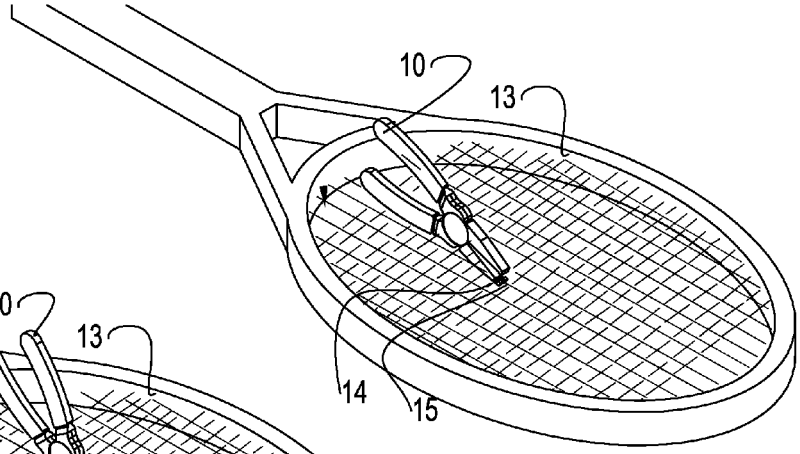
FIG. 8 is an exploded view of step 2 of how to use the string pliers on a strung racquet.
Figure 9:
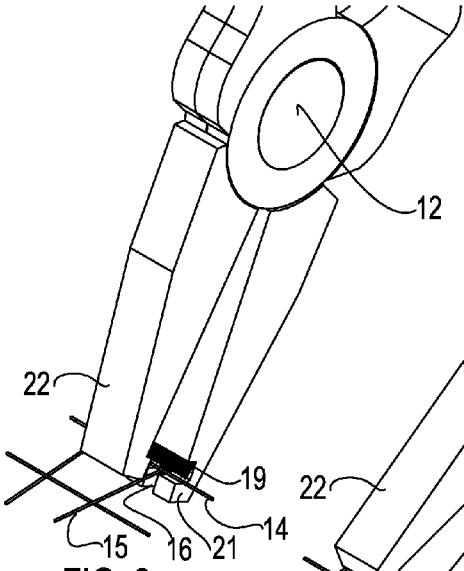
FIG. 9 is an exploded close up view of step 1 of how to use the string pliers on a strung racquet.
Figure 10:
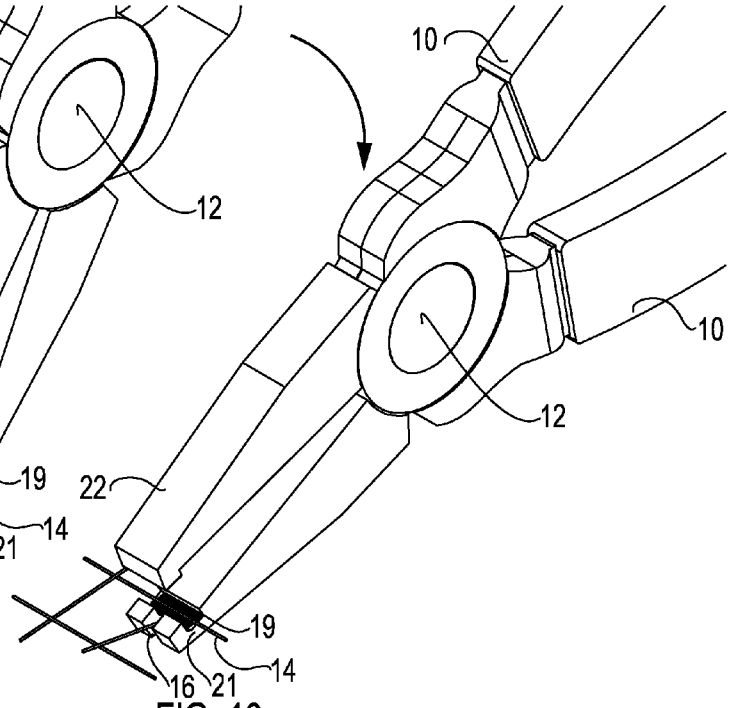
FIG. 10 is an exploded close up view of step 2 of how to use the string pliers on a strung racquet.
Figure 11:
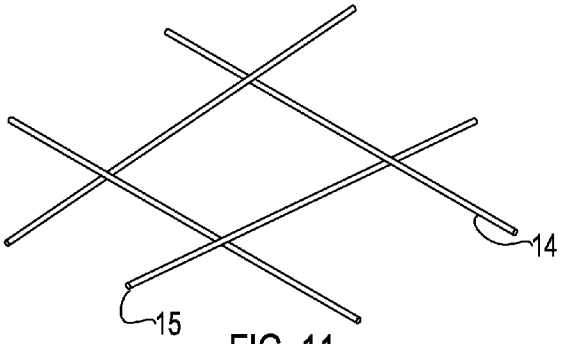
FIG. 11 is a close up front view of the tennis string before string pliers are used.
Figure 12:
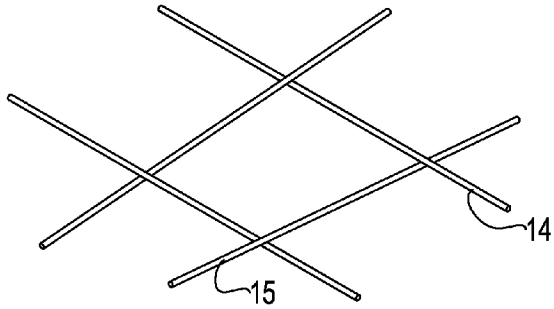
FIG. 12 is a close up back view of string before string pliers are used.
Figure 13:
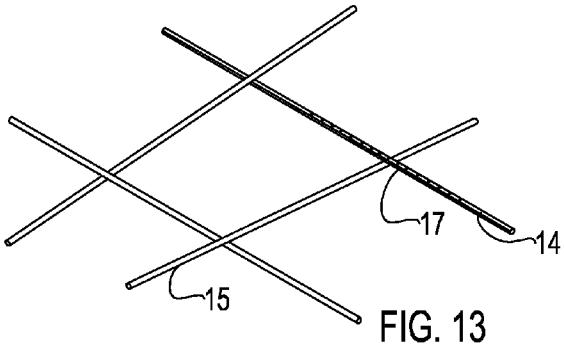
FIG. 13 is a close up front view of string after string pliers are used.
Figure 14:
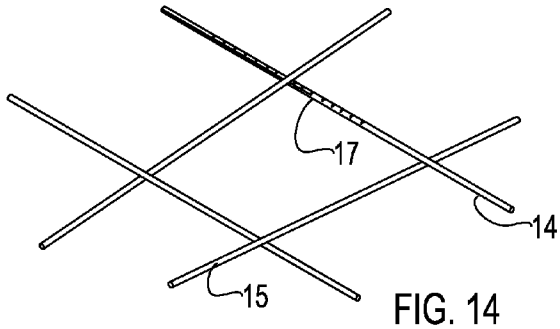
FIG. 14 is a close up back view of string after string pliers are used.

The manner in which the tool of the present invention is used to deform and roughen the surface of the string on a strung racquet is shown in FIG. 7-12. In FIG. 7, the player intends to make a series of indentations on a cross string 14 on a strung racquet 13. The player first puts the elevated L shaped string lockers 23 located at the end of lower jaw 21 under the cross string 14, while the main string 15 is inserted in the slot 16 located in the center of lower jaw 21. The L shaped string lockers 23 and the slot 16 lock both the main string 15 and the cross string 14 in place. This step is shown in greater detail in FIG. 9. The player then pushes down the plier handles 10, so the plier pivots about the cross string 14, As a result, the main string 15 is pushed down by the slot 16 and the lower jaw 21 is pushed under the cross string 14. Cross string 14 is then pushed on the recessed indentation 24 on lower jaw 21, and indentation 24 locks the cross string 14 in place, as indicated in FIG. 8 and FIG. 10. Finally, the player can close the pliers and leave a series of indentations on the cross string 14, as indicated in FIG. 11-14. FIG. 11 and FIG. 12 show the front and the back of cross string 14 before the pliers are used. FIG. 13 and FIG. 14 show the front and the back of cross string 14 after the pliers are used to depress the cross string 14. After the string is pressed, the pliers can then be opened and rotated upward to release the cross string 14 and main string 15.

The same manner can be repeated to put a series of indentations on the rest of the cross string 14 and the main string 15. The player needs to turn over the racquet and work on the other side of the racquet to complete roughening the string surface. It is not necessary to roughen all the strings on the racquet, it is sufficient to roughen the string in the "sweet spot", where the string makes contact with the balls most often. This covers about ½ the racquet area, in the center.

Figure 15:
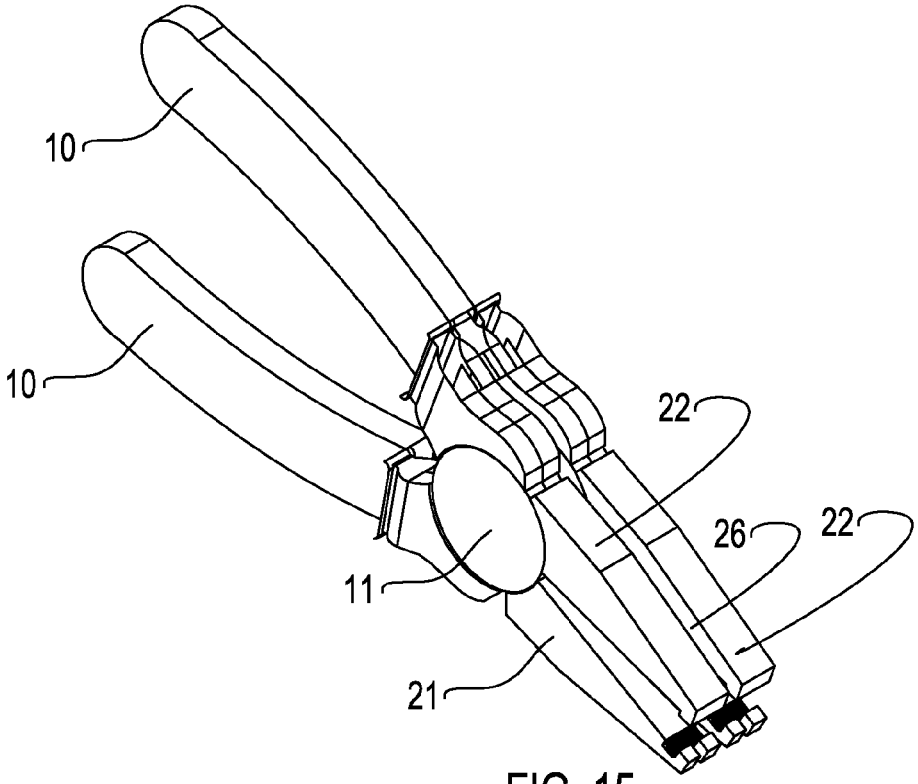
FIG. 15 is an exploded view of the two combined string pliers in accordance with the present invention.
Figure 16:
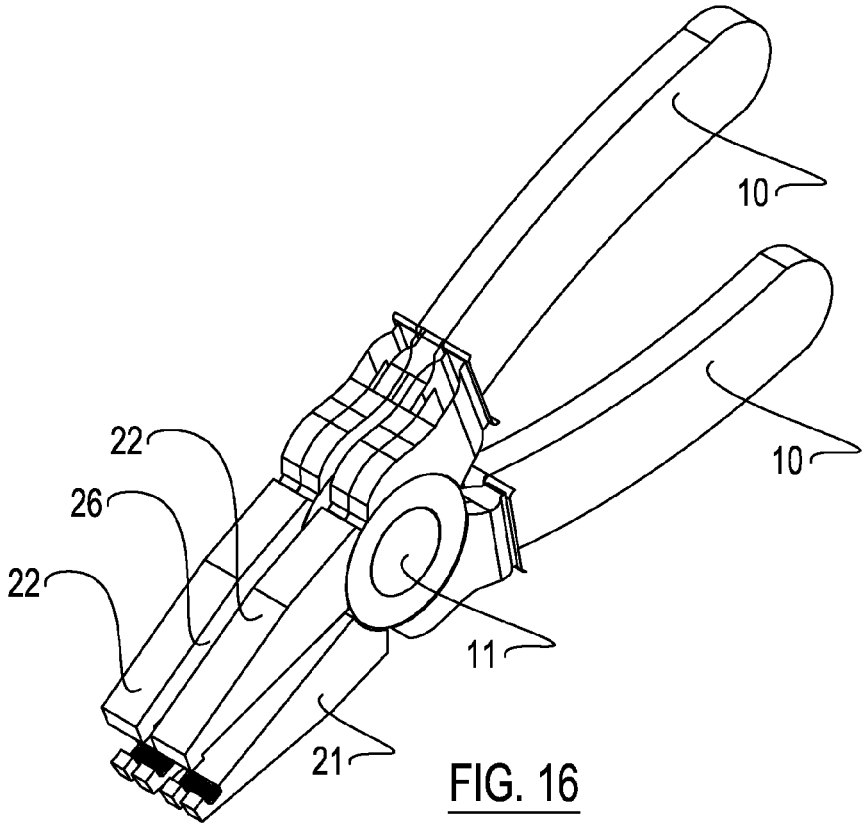
FIG. 16 is another exploded view of the two combined string pliers in accordance with the present invention.

Referring to FIG. 15 and FIG. 16, the pliers can be further modified so twice as much string can be depressed by the pliers at one time. The modification in general is to combine two upper jaws 22 and two lower jaws 21 together, and separate each pair of upper jaw 22 and lower jaw 21 with a long slot 26. The slot 26 is about ⅛" wide and 1" in depth. When cross string 14 is being depressed, both slots 24 allow 2 main strings 15 to be inserted and slot 26 allows one main string 15 to be inserted. Slots 24 push down two main strings 15, while slot 26 does not push down the main string 15.

The tool of the present invention is made from any suitable common metal such as steel alloy, aluminum alloy, and the like. The handles 10-10 of the tool may preferably be covered with an insulator such as plastic, or the like.

Although a preferred embodiment of the invention has been disclosed for the purpose of illustration, it will be understood that various changes, modifications, and substitutions may be incorporated in such embodiment within the scope of the invention without departing from the spirit of this invention.

What is claimed is:

1. A hand tool used for restructuring the surface of a synthetic fiber string on a strung tennis racquet by means of mechanically applied deformations of the material is comprised of: a pair of upper and lower jaws rigidly connected to handles, said upper and said lower jaw being pivotally connected for movement about a pivot axis in scissors-like relation, said upper jaw comprises first end and second end, said upper jaw first end comprises an elongated L shaped jaw tip located at the end of said upper jaw first end, an elevated pattern of line grids located on the surface of said elongated jaw tip; said lower jaw comprises first end and second end, said lower jaw first end comprises two L shaped string lockers, a slot between said two L shaped string lockers, a recessed indentation, located at the end of said lower jaw first end, an elevated pattern of line grids locate on the surface of said recessed indentation; a center line of said upper jaw and said lower jaw forming an angle with the center line of the handles of said tool, which varies from about 15° to about 30°.

2. The tool of claim 1 wherein said line grids located on the surface of said elongated jaw tip of said upper jaw comprise at least a block, a pyramid, a triangle or a half cylinder, the center line of said line grid forming an angle with the center line of said upper jaw of said tool which varies from about 15° to about 30°.

3. The tool of claim 1 wherein said two L shaped string lockers of said lower jaw are extruded from said upper jaw, said two L shaped string lockers lock a string in place and allow said lower jaw and said upper jaw to pivot about said string.

4. The tool of claim 1 wherein said slot between said two L shaped string lockers of said lower jaw pushes down a cross or a main string and separates said cross string from a main string, and allows said lower jaw to be inserted between said cross string and said main string on said strung racquet, said slot is about ⅛" in width and ¼" to 3⁄16" in depth from the end of said lower jaw.

5. The tool of claim 1 wherein said recessed indentation of said lower jaw is about ⅛"-½" wide and 3⁄16" to 5⁄16" deep, said line grids located on the surface of said recessed indentation of said lower jaw comprise at least a block, a pyramid, a triangle or a half cylinder, the center line of said line grid forming an angle with the center line of said lower jaw of said tool which varies from about 15° to about 30°.

6. The tool of claim 1 wherein said lower jaws and said upper jaw have an about 1⁄32" gap between a top surface of said line grids connected to said upper jaw and a top surface of said line grids connected to said lower jaw, and said line grids on said upper jaw are directly above, and parallel to said line grids on said lower jaw, upon closure of said upper jaw and said lower jaw.

7. The tool of claim 1 wherein said upper jaw can be combined to another said upper jaw, and said lower jaw can be combined to another said lower jaw, two pairs of said upper jaws and said lower jaws are separated by a slot which is about ⅛" in width and 1" in depth.

* * * * *